US010001009B2

(12) United States Patent
Bower et al.

(10) Patent No.: US 10,001,009 B2
(45) **Date of Patent: *Jun. 19, 2018**

(54) PUMPABLE MINE VENTILATION STRUCTURE

(71) Applicants: Heintzmann Corporation, Cedar Bluff, VA (US); ABC Industries, Inc., Warsaw, IN (US)

(72) Inventors: Joseph P. Bower, Morgantown, WV (US); John J. Breedlove, Cedar Bluff, VA (US); Erik Denver, Keen Mountain, VA (US); Steven S. Fleagle, Syracuse, IN (US); Tyler Proffitt, Pounding Mill, VA (US)

(73) Assignees: FCI Holdings Delaware, Inc., Wilmington, DE (US); ABC Industries, Inc., Winona Lake, IN (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 14/627,058

(22) Filed: Feb. 20, 2015

(65) Prior Publication Data

US 2016/0245082 A1 Aug. 25, 2016

Related U.S. Application Data

(62) Division of application No. 14/174,984, filed on Feb. 7, 2014, now Pat. No. 9,022,689.

(60) Provisional application No. 61/854,223, filed on Apr. 19, 2013, provisional application No. 61/846,698, filed on Jul. 16, 2013.

(51) Int. Cl.

| | |
|---|---|
| ***E21D 15/00*** | (2006.01) |
| ***E21F 7/00*** | (2006.01) |
| ***E21F 1/14*** | (2006.01) |
| ***E21F 17/107*** | (2006.01) |
| ***E21D 11/00*** | (2006.01) |

(Continued)

(52) U.S. Cl.

CPC ..... *E21F 7/00* (2013.01); *E21D 11/003* (2013.01); *E21D 11/04* (2013.01); *E21D 13/00* (2013.01); *E21F 1/14* (2013.01); *E21F 17/107* (2013.01)

(58) Field of Classification Search

USPC ..... 405/132, 151, 288, 289; 299/11, 12; 454/168, 169, 170

See application file for complete search history.

(56) References Cited

U.S. PATENT DOCUMENTS 3,937,025 A * 2/1976 Alvarez-Calderon F. ..... E21F 15/04 299/11

6,082,828 A * 7/2000 Bailey ..... E21F 17/103 299/12

(Continued)

OTHER PUBLICATIONS http://www.dictionary.com/browse/weep.*

*Primary Examiner* — Sean D Andrish

(74) *Attorney, Agent, or Firm* — The Webb Law Firm

(57) ABSTRACT

A pumpable mine ventilation stopping wall structure comprised of a pumpable bag having spaced walls of generally parallel nonporous and flexible sheets with the sheets retained in spaced relationship with spaced flexible cross ties. The perimeter of the spaced walls may be closed off with a permeable mesh having a mesh size which will permit restricted flow of cementitious grout therethrough for sealing the wall structure to surrounding rough mine faces. The bag is provided with at least one grout fill port for filling the bag by pumping cementitious grout into the bag.

2 Claims, 7 Drawing Sheets

(51) Int. Cl.
*E21D 11/04* (2006.01)
*E21D 13/00* (2006.01)

(56) References Cited

U.S. PATENT DOCUMENTS

| | | | | |
|---|---|---|---|---|
| 6,558,085 | B1 * | 5/2003 | Hall | E21D 15/005 405/288 |
| 9,022,689 | B2 * | 5/2015 | Bower | E21F 1/14 405/132 |
| 2010/0247249 | A1 * | 9/2010 | Skarbovig | E21D 15/483 405/289 |

* cited by examiner

PUMPABLE MINE VENTILATION STRUCTURE

CROSS REFERENCES

This application is a division of patent application Ser. No. 14/174,984, filed Feb. 7, 2014, which claims the benefit of U.S. Provisional Patent Application No. 61/854,223, filed Apr. 19, 2013, and U.S. Provisional Patent Application No. 61/846,698, filed Jul. 16, 2013, the contents of which are incorporate herein by reference in their entireties.

BACKGROUND OF THE INVENTION

The present invention relates to a mine ventilation structure used to block a passageway or to prevent mixture of ventilation air at the intersection of two passageways. The ventilation structure blocking a passageway can be a shaft partition, stopping or regulator. The ventilation structure preventing the mixture of ventilation air at the intersection of two passageways can be an overcast or an undercast.

In an underground mine having a grid of intersecting passageways separated by columns of remaining material, there is need for a ventilation system as the mining activity becomes more distant from a source of ventilation. In a typical ventilation system, intake air and return air are ducted through air shafts formed by selected passageways. Along the air shafts, intersecting passageways are blocked with a partition or ducted through an overcast or an undercast.

The return air in a coal mine contains coal dust and methane so it is important that there is no intermingling of the return air with the intake air. Permanent barriers, such as those constructed of concrete block, steel plates or the like, have been used to define the passageways forming the air shafts. Even though the prior art structures are treated with sealants, a significant amount of air leaks through these structures, heard in the mine as a sucking sound. At an overcast or undercast, the leaks result in intermingling of the return and intake air at the barriers resulting in a significant loss of pressure when repeated at multiple barriers along shafts that may extend for thousands of feet.

In addition to leaking air, prior art partitions, overcasts and undercasts made of concrete blocks, steel plates and the like, require large amounts of materials that are heavy and difficult to transport and handle in the confined space within a mine, and the structures are very time consuming to construct.

As mining advance rates become faster, installation rates of ventilation overcasts and ventilation stoppings have to increase. Ventilation overcast and stopping sites are either cut out of the roof of the mine with a continuous miner or shot out with explosives. Either method of removing the roof leaves the surrounding rock walls uneven and jagged. The rough wall faces makes sealing of mine stoppings or the wing walls of the overcast extremely difficult.

SUMMARY OF THE INVENTION

A principal feature of the pumpable wall structure of the present invention is that the wall structure is comprised of a pumpable bag structure having opposing flexible bag faces with a mesh around or surrounding the outside perimeter of the bag to allow the cementitious material when pumped into the bag to escape through the mesh and bond to the rough rock face of the mine, thereby providing an effective seal.

The pumpable mine ventilation wall structure of the present invention is suitable for use for mine ventilation stoppings or the wing walls of an overcast. The pumpable wall structure is comprised of a pumpable bag having spaced walls of generally parallel nonporous and flexible sheets with the sheets being retained in spaced relationship with spaced flexible cross ties. The vertically positioned bag structure may be initially secured at its perimeter to the mine faces and/or initially supported by a framework.

The outer perimeter of the spaced walls of the bag are closed off with a permeable mesh having a mesh size which will permit restricted flow of a settable cementitious grout therethrough for sealing to surrounding rough mine faces. The bag is provided with at least one grout fill port penetrating one of the flexible walls for pumping grout into and filling the bag.

The pumpable mine ventilation stopping wall structure may also include an internal reinforcement mesh layer between the spaced walls which adds reinforcing strength to the completed wall structure once the settable cementitious grout has cured. Additionally, a man door opening may be cut out of the cured structure or preformed into the wall structure.

An additional embodiment of the present invention is provided in the form of a pumpable mine ventilation overcast for segregating the ventilation flow of intersecting mine passageways. The overcast structure includes an overcast tunnel structure with vertical end wing walls for sealing off the passage of the tunnel structure to surrounding mine passageway faces.

The overcast is comprised of an overcast tunnel framework and at least one pumpable bag having spaced walls of generally parallel nonporous and flexible sheets which covers over and is secured to the tunnel framework. The tunnel framework is preferably constructed of lightweight metal and is expandable and adjustable for ease of transport, construction and installation.

The pumpable bag is provided with at least one fill port and at least one exhaust port for filling the bags with a liquid fill, preferably a pumpable cementitious grout. End wing walls for the tunnel structure are then formed with the pumpable mine ventilation stopping wall structure previously described or with pumpable vertical bags which do not have a mesh perimeter. In the latter case, the perimeter of the end walls may be sealed to the surrounding mine faces with a suitable externally applied foam or grout.

BRIEF DESCRIPTION OF THE DRAWINGS

Other objects and advantages appear hereinafter in the following description and claims. The appended drawings show, for the purpose of exemplification, without limiting the scope of the invention or the appended claims, certain practical embodiments of the present invention wherein:

DETAILED DESCRIPTION OF PREFERRED EMBODIMENTS

Figure 1:
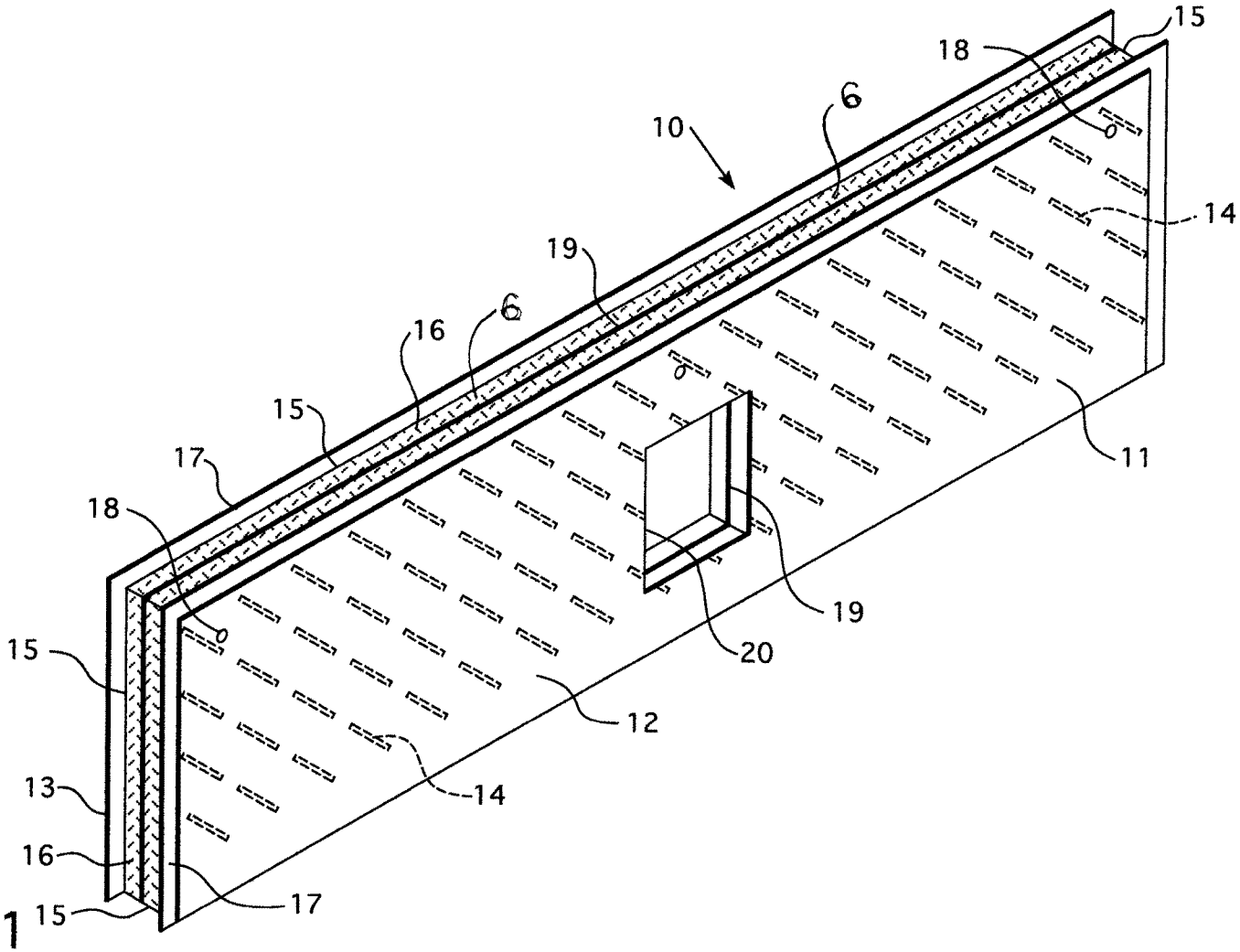
FIG. 1 is an isometric view of the pumpable ventilation stopping of the present invention.
Figure 2:
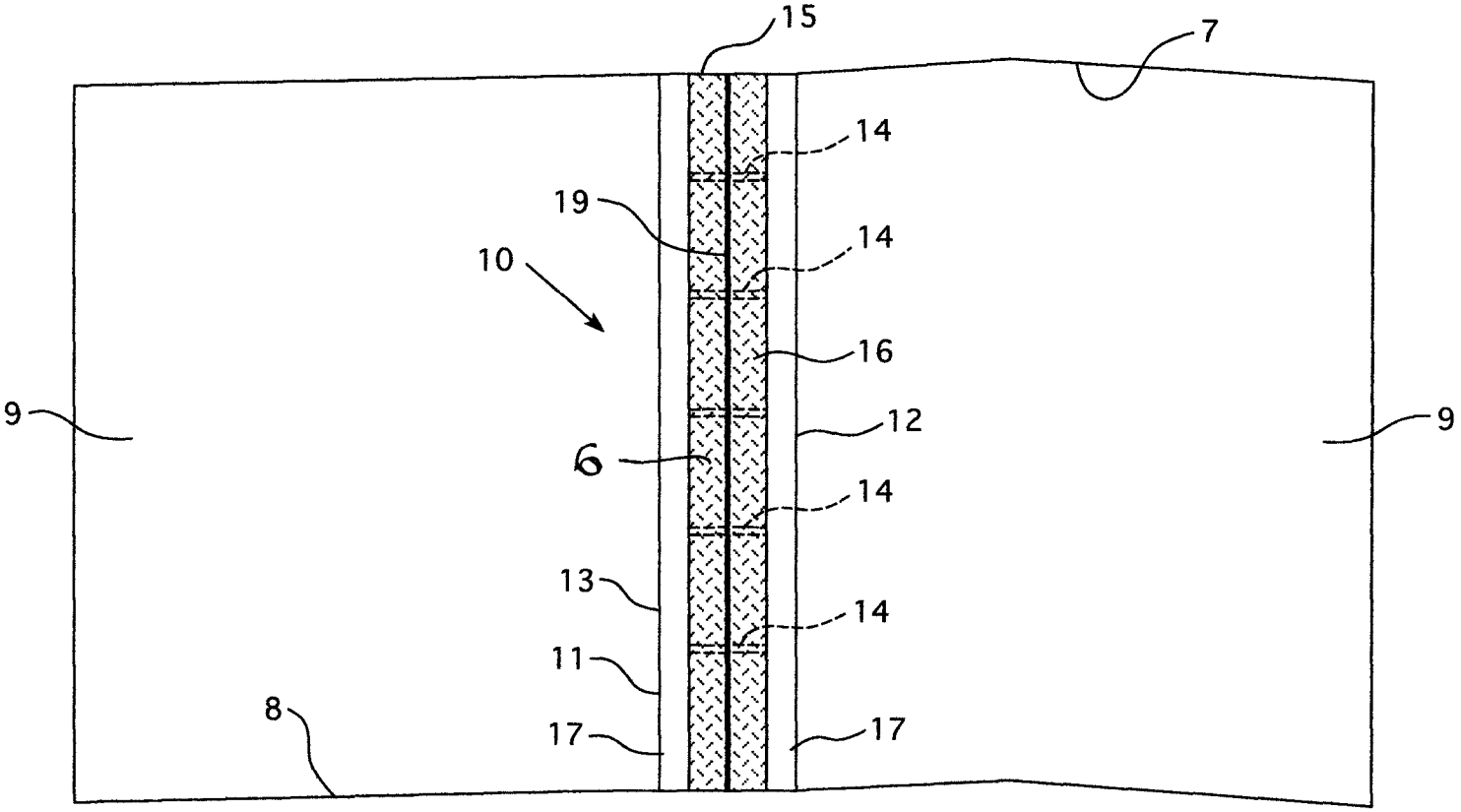
FIG. 2 is a side view or end view in elevation of the pumpable stopping shown in FIG. 1.
Figure 3:
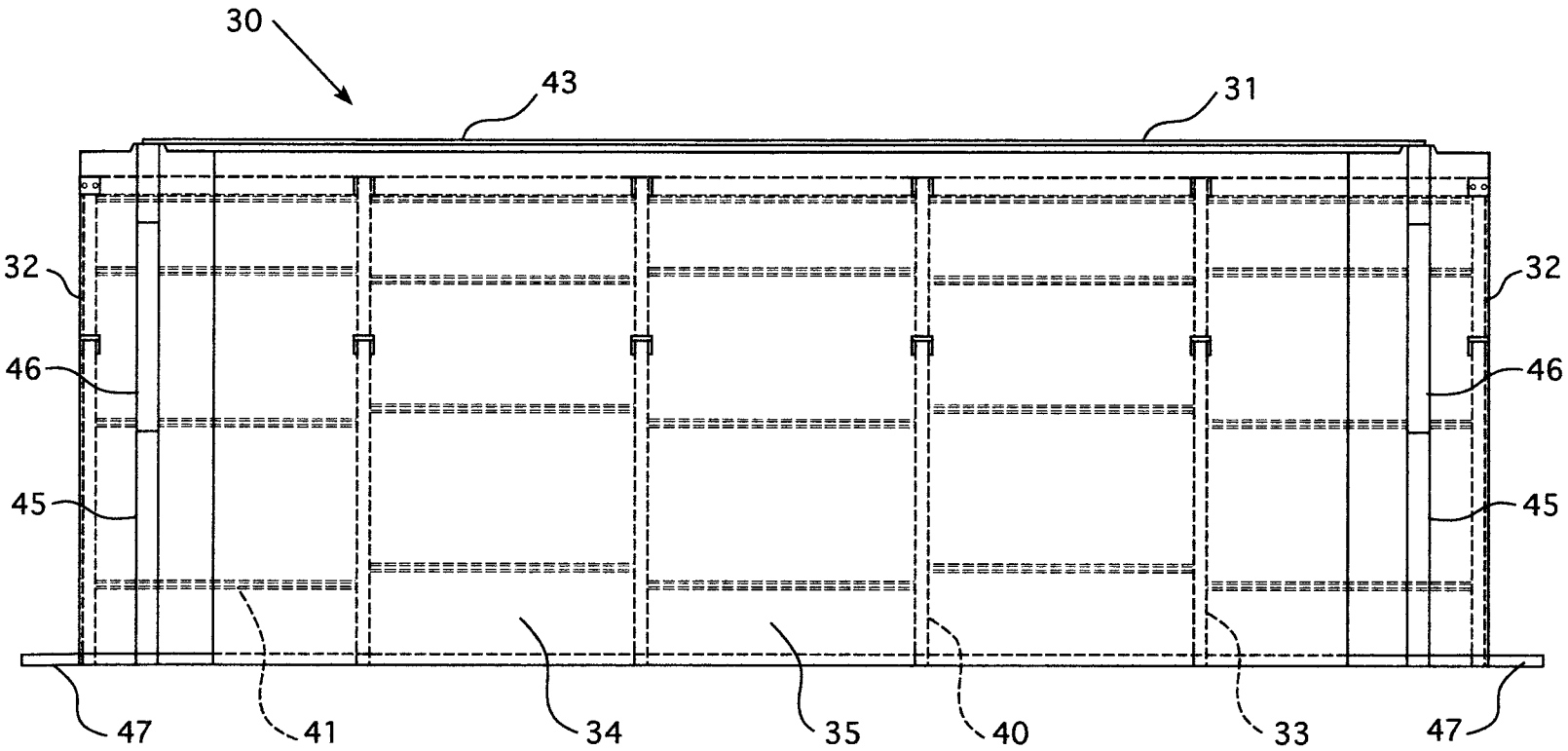
FIG. 3 is a view in side elevation of a trapezoidal overcast constructed in accordance with the teachings of the present invention.

Referring first to FIGS. 1 and 2, the pumpable ventilation stopping wall structure 10 of the present invention is comprised of a pumpable bag 11 having spaced walls 12 and 13 of generally parallel nonporous and flexible sheets. The sheets are nonporous in the sense that they will not permit penetration of a pumpable fill or grout. The sheets of walls 11 and 12 are retained in spaced relationship with spaced flexible cross ties 14. The walls 11 and 12 may be constructed of any suitable flexible material, such as geotextile fabric, plastic or fabric reinforced plastic. Cross ties 14 are preferably constructed of a strong flexible material, as opposed to a rigid material, and they are secured at their opposite ends to the opposing faces of walls 12 and 13 of bag 11.

The perimeter 15 of spaced walls 12 and 13 are closed off with a permeable mesh 16 having a mesh size which will provide an exhaust port for air to escape past the perimeter 15 of walls 12 and 13 of bag 11 between the mine walls 7, 8 and 9 and the perimeter 15 and also permit restricted flow of a cementitious grout therethrough for sealing to the rough surrounding mine faces, including the mine roof 7, floor 8 and sidewalls 9. Permeable mesh 16 is preferably a nonmetallic mesh and is bonded to the opposing vertical sidewalls 12 and 13 of bag 11 by flexible flanges 17. Flanges 17 also provide a means of preliminarily securing the vertical bag structure to surrounding mine passageway faces or surfaces.

Bag 11 is provided with two grout fill ports 18 for filling bag 11 and sealing the perimeter of bag 11 with surrounding mine surfaces.

An internal reinforcement mesh layer 19 is provided between the spaced walls 12 and 13 for reinforcement of the wall structure after the cementitious grout filling has cured. After curing of the cementitious grout fill, a man door opening 20 may be cut through the stopping wall structure 10 and a sealed door (not shown) installed. Alternatively the man door opening 20 may be constructed by installing appropriate framing within the bag 11 prior to the bag 11 being pumped with the settable grout.

The cementitious grout is permitted to ooze and migrate through the mesh perimeter 16 and to thereby bond to the surrounding irregular rock surface of the mine floor 8, roof 7 and sidewalls 9, thereby creating an airtight seal with the irregular mine surfaces upon setting of the grout.

The pumpable ventilation wall structure illustrated in FIGS. 1 and 2 may be used not only for mine stoppings, but additionally may be utilized for the construction of wing walls of a mine ventilation overcast as described hereinafter.

Referring next to the overcast structures illustrated in FIGS. 3 through 7, the pumpable mine ventilation overcast embodiment of the present invention is described. The pumpable mine ventilation overcast 30 is constructed for segregating the ventilation flow of intersecting mine passageways, and includes an overcast tunnel structure 31 with end wing walls 32 for sealing off the passage of the tunnel structure 31 to surrounding mine passageway faces. The overcast tunnel structure 31 is constructed of a lightweight tunnel framework 33 and a pumpable bag 34. Pumpable bag 34 is constructed of spaced walls 35, 36 and roof 49 of generally parallel nonporous and flexible sheets. The pumpable bag 34 is provided with at least one fill port 37, and at least one exhaust port, for filling the bag with a fluid fill. As before, the bag or bags 31 are constructed of a flexible material, such as geotextile fabric, plastic or fabric reinforced plastic. The exhaust port in this embodiment is in the nature of the walls 35 and 36 which are impervious to the flow of grout but permit the penetration of air. Alternatively the walls 35 and 36 may also be impervious to air flow and specific air exhaust vents provided. The overcast tunnel framework 33 is constructed of lightweight metal pipe struts 40 and interconnecting tie rods 41 and is quickly expanded and constructed due to the hinged connections 44. The flexible pumpable bag 34 is laid over and secured to the framework 33 with tie rod sleeves or ties 42.

The end wing walls 32 are constructed in the same manner as bag 34 are secured to or mated to the outer ends of bag 34 and the bags for end walls 32 are also filled at fill ports 37 with a fluid fill. Wing walls 32 are initially retained in their vertical support position illustrated by frames 45 which pass through wing wall retaining sleeves 46 to initially support the wing walls in their vertical position prior to being filled.

Figures 4A, 4B:
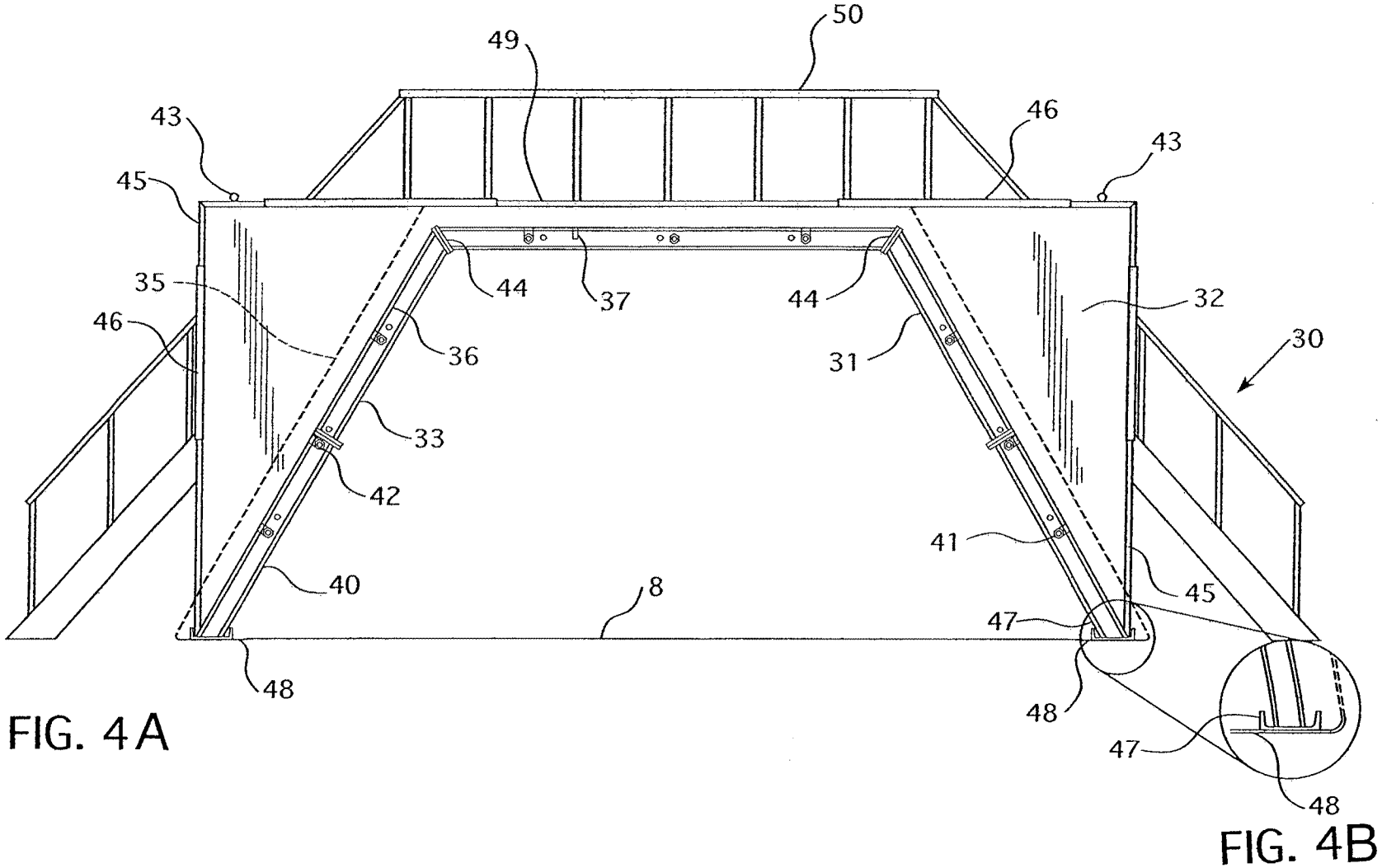
FIG. 4A is a right end view in elevation of the overcast structure shown in FIG. 3 illustrated with the inclusion of a walkway constructed over the overcast structure and FIG. 4B is an exploded view of the lower right hand corner of the structure shown in FIG. 4A.
Figure 5:
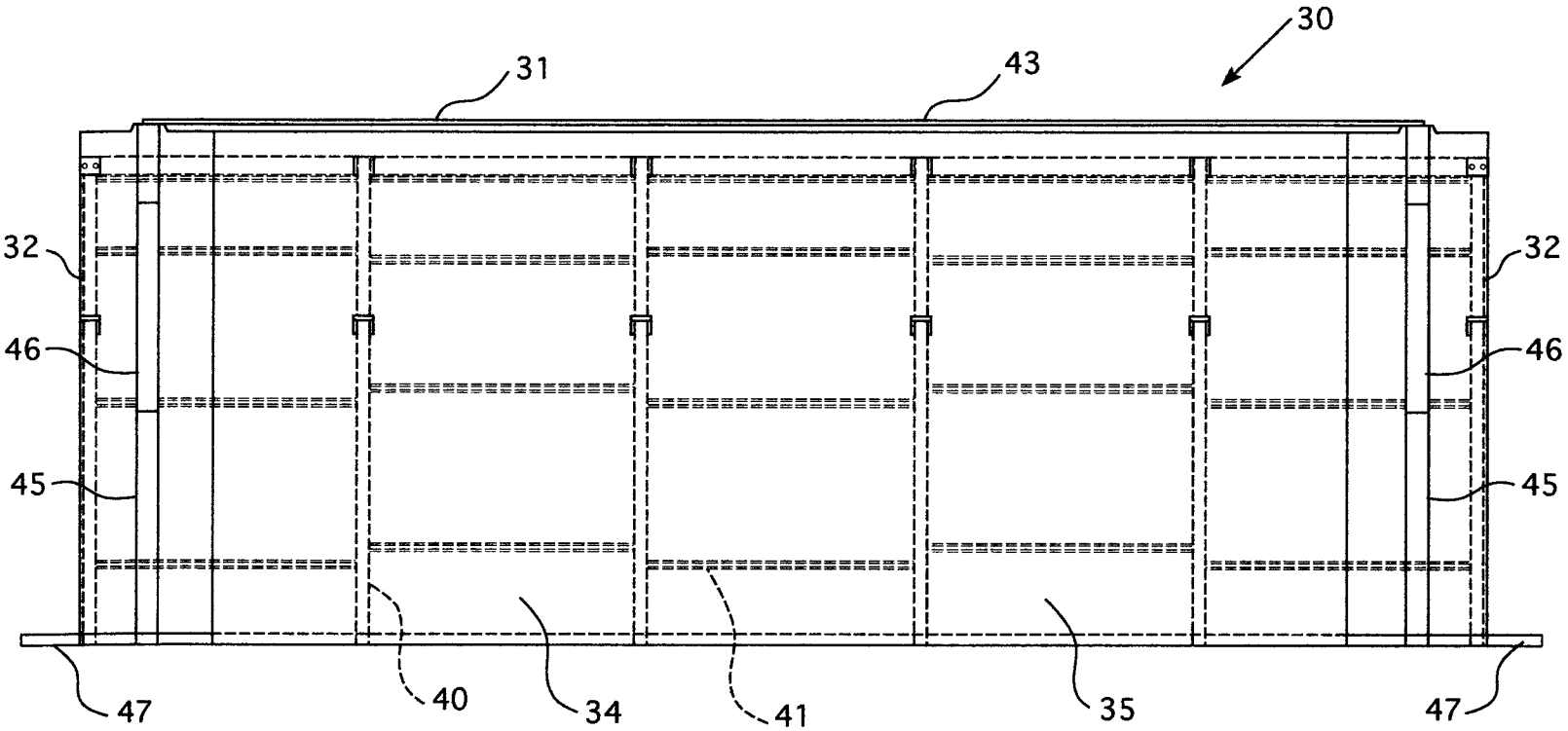
FIG. 5 is a view in side elevation of an overcast structure constructed in accordance with the teachings of the present invention and having a semi-circular cross section.
Figures 6A, 6B:
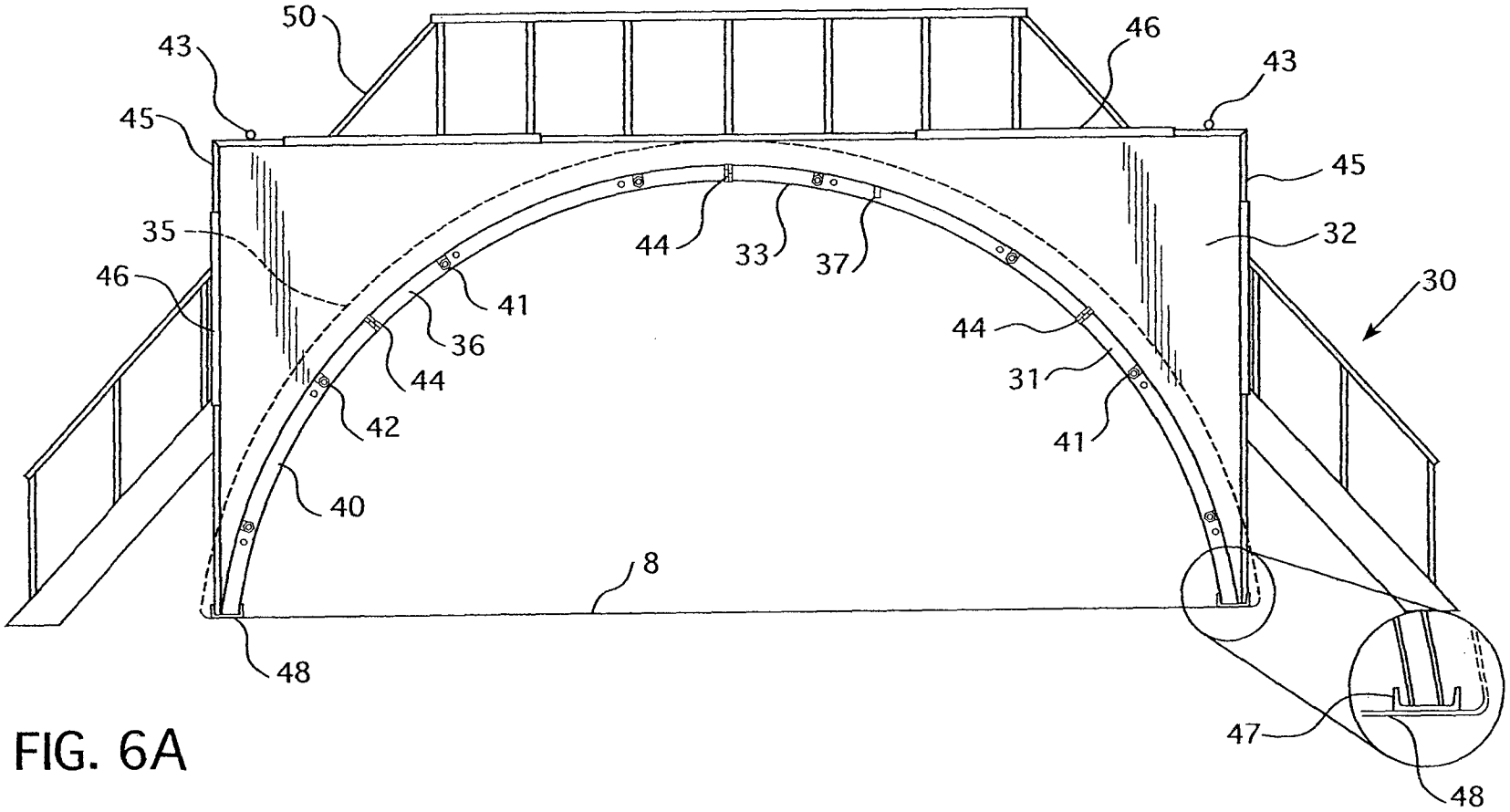
FIG. 6A is a right side end view of the overcast shown in FIG. 5 with the additional inclusion of a walkway structure provided over the overcast and FIG. 6B is an exploded view of the lower right hand corner of the structure shown in FIG. 6A.
Figure 7:
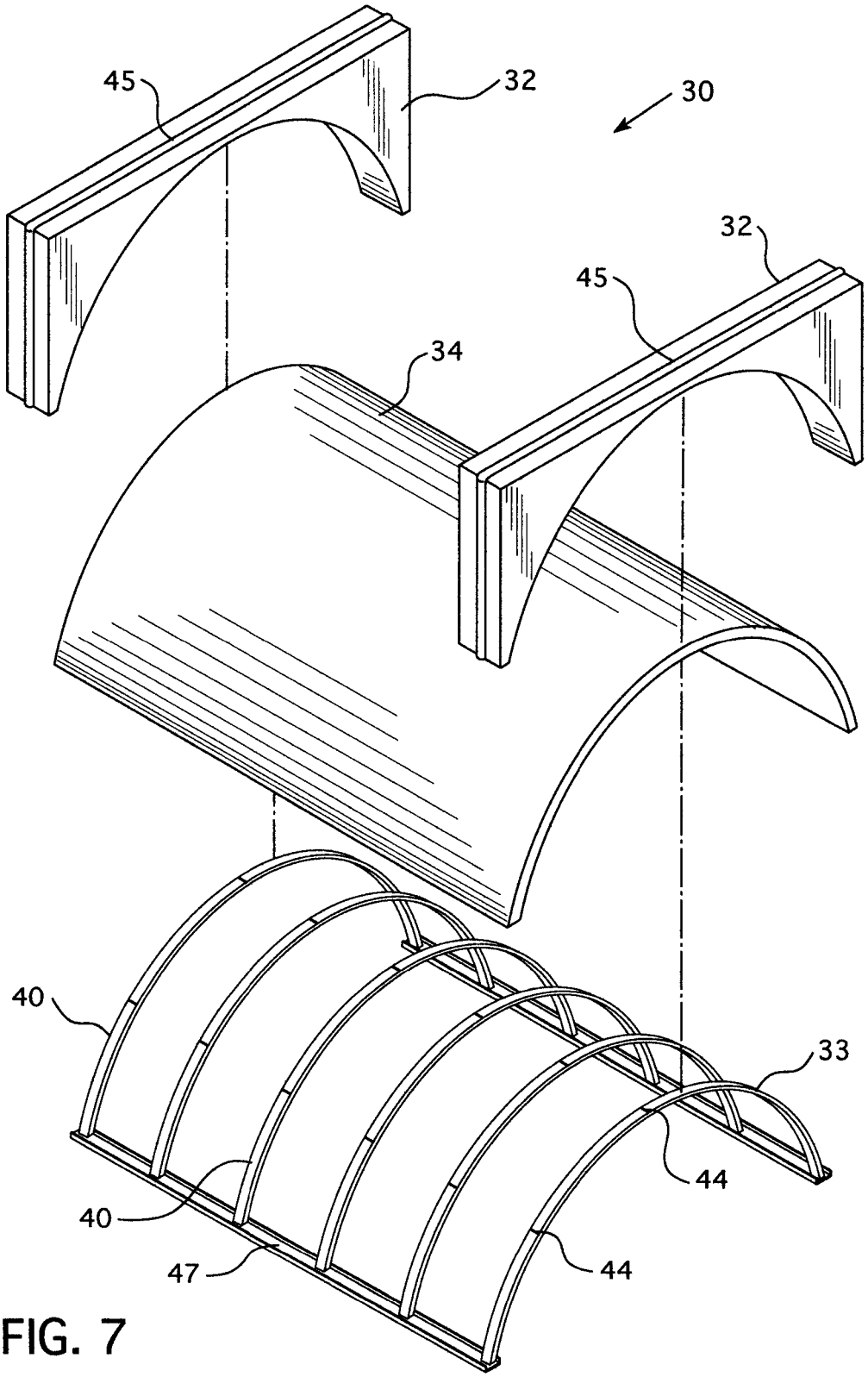
FIG. 7 is an exploded schematic view illustrating the interrelation between the structural parts utilized to construct the overcast structure shown in FIGS. 5 and 6.

Inflatable bag 34 is also secured to the mine floor by pins or dowels (not shown) or by securing the bottom edges 48 of bag 34 under the framework 33. The framework 33 may be provided with any desired cross sectional configuration, such as trapezoidal as illustrated in FIG. 4 or as semicircular as illustrated in FIG. 6.

The bag 34 and wing walls 32 may be pumped full of any suitable fill, such as cement, foam, and/or sand or aggregate. However, the preferable fill is settable cementitious grout which may be readily pumped to the construction site from a remote location and cures to provide a solid structure.

The pumpable bag 34 and pumpable wing wall bags of wing walls 32 may be provided with connecting flaps or strips which can either be sealed to the mine roof/rib/floor either by mechanically securing the perimeter or by applying a cement or foam sealant around the perimeter of the bags and their supporting framework.

A walkway 50 may be provided for passage over the overcast structure 30 and can be made to conform to the structure and laid against the structure or may stand alone. The framework 33 is provided with base channels 47 which serve to provide an anchoring point of the framework 33 to the mine floor and also aid in sealing the base of the bag 34 to prevent air loss. Bottom flaps edges 48 of bag 34 are passed under the bottom channels 47 to provide sealing. In addition, base channels 47 also provide skids upon which the framework structure can be slid or moved to place the overcast structure into position.

A second method may be provided by pinching the overlap of the bags of end walls 32 between the wing wall frame 45 and the mine roof or rib. Also, the top cross bars 43 of tunnel structure 31 are compression rods which provides a clamping effect on the wing wall bags of end walls 32 which are folded over the wing wall frame 45.

In a preferable embodiment, wing walls 32, instead of being constructed as just described, are preferably constructed in the same manner as the pumpable wall structure of FIGS. 1 and 2, and the wing walls 32 are then pumped with cementitious grout and the outer perimeters of the wing walls are thereby sealed to the mine wall faces. In addition, when the wing walls are constructed in this manner, the provision of wing wall support frames 45 is not required, as the wing walls may then be pumped into position or the perimeters thereof initially secured to the mine wall faces with flanges 17 before pumping.

We claim:

1. A method of constructing a mine ventilation stopping wall structure in a mine shaft, comprising;

constructing in a mine shaft a pumpable bag having spaced walls of generally parallel nonporous and flexible sheets retained in spaced relationship with cross ties and with outer perimeter edges of said spaced walls closed off therebetween with a permeable mesh having a mesh size which permits restricted flow of a cementitious grout therethrough and extending and supporting said perimeter edges to engage surrounding faces of a mine shaft;

pumping a settable fluid cementitious grout into said bag through a fill port and thereby filling said bag while exhausting entrapped air and fluid cementitious grout in said bag through said permeable mesh; and sealing said wall at said perimeter edges to surrounding mine surfaces of the mine shaft with cementitious grout flowing through said permeable mesh.

2. The method of claim 1 including providing a man door opening in said wall structure.

* * * * *